US007178485B2

(12) United States Patent
Dague

(10) Patent No.: US 7,178,485 B2
(45) Date of Patent: Feb. 20, 2007

(54) STEAM GENERATOR THAT INCLUDES A FEEDWATER DELIVERY DEVICE

(75) Inventor: Gilles Dague, Paris (FR)

(73) Assignee: Framatome ANP, Courbevoie (FR)

( * ) Notice: Subject to any disclaimer, the term of this patent is extended or adjusted under 35 U.S.C. 154(b) by 350 days.

(21) Appl. No.: 10/767,992

(22) Filed: Feb. 2, 2004

(65) Prior Publication Data

US 2006/0070586 A1 Apr. 6, 2006

(30) Foreign Application Priority Data

Feb. 12, 2003 (FR) ..... 03 01684

(51) Int. Cl.
*F22D 1/00* (2006.01)

(52) U.S. Cl. ..... 122/438; 122/412; 122/414

(58) Field of Classification Search ..... 122/412, 122/414, 418, 441, 438; 376/313, 314, 316; 137/561 A See application file for complete search history.

(56) References Cited

U.S. PATENT DOCUMENTS

| | | | | |
|---|---|---|---|---|
| 3,661,123 A | * | 5/1972 | Romanos | 122/34 |
| 3,991,720 A | * | 11/1976 | Byerley | 122/32 |
| 4,502,419 A | * | 3/1985 | Smith, Jr. | 122/32 |
| 4,917,146 A | * | 4/1990 | Sundheimer et al. | 137/561 A |
| 5,083,529 A | | 1/1992 | Sundheimer | |
| 5,390,219 A | | 2/1995 | Poussin et al. | |
| 6,173,680 B1 | * | 1/2001 | Dague et al. | 122/441 |

FOREIGN PATENT DOCUMENTS

| | | |
|---|---|---|
| FR | 2778223 | 11/1999 |
| JP | 10122502 | 5/1998 |

OTHER PUBLICATIONS

French Search Report dated Nov. 5, 2003, 2 pages.

* cited by examiner

*Primary Examiner*—Gregory Wilson
(74) *Attorney, Agent, or Firm*—Connolly Bove Lodge & Hutz LLP

(57) ABSTRACT

The steam generator includes a feedwater delivery device at an upper axial end of an annular space between an outer shell and a bundle wrapper of the steam generator. The feedwater, delivery device includes a header (11) having a shell of toroidal general shape, at least one feed pipe for the header and feedwater distribution means (14) in the upper part of the annular space of the steam generator. The feedwater distribution means (14) include a plurality of openings (17) that pass through the upper part of the shell of the toroidal header (11) and are distributed circumferentially on the wall of the header and a plurality of tubes (15) fixed via a lower end part at an opening (17) of the header (11). Each of the straight tubes (15) includes an upper end part through which openings (20), such as water passage slots, pass and a cap (16) fixed to the upper end of the tube (15) surrounding, with a radial clearance, the upper end part of the tube (15). In this way, the feedwater is properly distributed and foreign bodies possibly contained in the feedwater are trapped.

9 Claims, 5 Drawing Sheets

STEAM GENERATOR THAT INCLUDES A FEEDWATER DELIVERY DEVICE

FIELD OF THE INVENTION

The invention relates to a steam generator that includes a feedwater delivery device for trapping foreign bodies.

BACKGROUND OF THE INVENTION

Steam generators, such as the steam generators of nuclear reactors cooled by pressurized water, comprise an outer shell of cylindrical general shape placed vertically in a nuclear reactor building, that is to say with the axis of the outer shell lying vertically.

The steam generators of pressurized-water nuclear reactors heat and vaporize feedwater by heat exchange with the pressurized cooling water of the nuclear reactor that circulates inside tubes of a-heat exchange bundle. The tube bundle is placed inside a bundle wrapper of cylindrical general shape, which is placed coaxially inside the outer shell.

The tubes of the bundle are fixed at their ends in a tube plate so that they open, at a first end, into a first part of a water box of the steam generator and, at a second end, into a second part of the water box of the steam generator. The water box of the steam generator makes it possible to distribute the pressurized water coming from the nuclear reactor vessel in which the core, consisting of fuel assemblies, is placed and to recover the pressurized water that has circulated inside the exchange tubes so as to return it to the nuclear reactor vessel.

Feedwater for the steam generator is introduced through the outer shell and channelled so as to enter an inlet part of the exchange bundle, at the lower part of the bundle and of the bundle wrapper. The feedwater then flows upwards inside the bundle wrapper in contact with the external surface of the tubes in such a way that it is heated then vaporized and is in vapour form in the upper part of the outer shell of the steam generator. The steam recovered in the upper part of the steam generator passes into separator-dryers and is sent to the turbine of the reactor.

The feedwater is generally introduced into the upper part of an annular space provided between the tube bundle wrapper and the outer shell or between the bundle wrapper and a skirt defining a circulation space that communicates with an end part-of the bundle formed by the ends of the bundle tube legs called cold legs, via which the cooling water that has served for heating and vaporizing the feedwater leaves.

It is also possible to provide a feed space bounded by a skirt coaxial with the outer shell and with the bundle wrapper of the steam generator in order to preheat the feedwater by circulation in contact with the bundle wrapper and in contact with the cold legs of the bundle tubes.

In all cases, the feedwater introduced into the shell of the steam generator flows downwards in an annular space of vertical axial direction, down to the lower part of the bundle wrapper.

To achieve high efficiency of the steam generator and satisfactory operating conditions, it is necessary to distribute the flow of feedwater around the circumference of the annular feed space of the steam generator, at the upper part of this annular space. To do this, a feedwater delivery device is used at the upper axial end of the annular space, this device comprising a header of toroidal general shape approximately coaxial with the outer shell and with the annular space. The header is placed inside the outer shell of the steam generator, vertically in line with the upper part of the annular water feed space. The header is connected to a water feed pipe that passes through the outer shell of the steam generator and includes feedwater distribution means distributed around the circumference of the annular water feed space. The feedwater distribution means may be formed by a plurality of openings that pass through an upper wall of the toroidal header and are distributed circumferentially around the wall of the header, to each opening a tube of approximately vertical direction may be fixed. Each tube is fixed to the wall of the header by a lower end part, the upper end part of the tube being able to be bent so as to direct the feedwater downwards into the upper part of the annular space. In this known embodiment of the prior art, the tubes, in the form of an upside-down J, have a vertical cold leg fixed to the header and a loop directed downwards towards the upper part of the annular feed space.

The feedwater, which is fed into the header, having the shape of a torus or a portion of a torus, may contain foreign bodies consisting in particular of metal machining or welding debris or of mechanical fixing means such as bolts, particularly during the first phases of operation of the steam generator and of the secondary water feed system, after they have been manufactured in the factory and mounted on the site of the nuclear reactor. Foreign bodies may also be introduced into the annular space of the steam generator with the condensation water coming from the upper part of the steam generator containing the steam separator-dryers.

Such foreign bodies entrained by the feedwater flowing at high speed in the steam generator constitute migrating bodies that may result in the destruction of certain parts of the secondary system or of the steam generator. In particular, migrating bodies are liable to become trapped between the tubes of the steam generator bundle and damage or destroy the tubes with which they are in contact.

It has therefore been proposed to use filtration devices for stopping the foreign bodies entrained by the steam generator feedwater and liable to be entrained into the annular circulation space of the steam generator.

Such filtration devices comprise, for example, one or more screens placed in the meridional section of the header in order to stop the foreign bodies or debris circulating with the feedwater.

In the case of large debris striking the screens, such debris may be sent back towards the feed pipe of the header or may damage the screens so that the screens become less effective for filtering the feedwater.

BRIEF DESCRIPTION OF THE INVENTION

The object of the invention is therefore to propose a steam generator comprising an outer shell of cylindrical general shape placed with its axis vertical, a bundle of exchange tubes that are fastened inside a bundle wrapper of cylindrical general shape placed coaxially inside the outer shell so as to define, with one of the outer shell and of a skirt coaxial with the outer shell, an annular space for water from the steam generator to flow axially and a feedwater delivery device, at an upper axial end of the annular space, comprising a header of toroidal general shape approximately coaxial with the outer shell and with the annular space, at least one feed pipe for the header passing through the outer shell and means for distributing the feedwater in the upper part of the annular space, these means being formed by a plurality of openings that pass through an upper wall of the toroidal header and are distributed circumferentially on the wall of the header and a plurality of substantially vertical tubes that are fixed by a lower end part, each at an opening in the wall of the toroidal header, the feedwater delivery device of the steam generator ensuring optimal distribution of the feedwater in the annular space and effective stopping of foreign bodies circulating with the feedwater, lowering the risk of the filtration function being interrupted or deteriorating appreciably.

For this purpose, the feedwater distribution-tubes are straight and placed vertically and each of the tubes has, in an upper end part, at least one water passage opening passing through the wall of the tube and a cap that is fastened to the tube and has a lateral wall of substantially cylindrical shape and a top covering the upper end of the tube, in an approximately coaxial arrangement, surrounding, with a radial clearance, the upper end part of the tube through which the water passage opening passes, at least one dimension of which is less than a characteristic dimension of foreign bodies contained in the feedwater.

According to more particular embodiments of the invention:

- the tube of each of the feedwater distribution means includes, in an upper end part, a plurality of slots of axial longitudinal direction that are distributed around the circumference of the tube and having, in the circumferential direction, a width of less than a characteristic dimension of foreign bodies that is desirable to trap in the feedwater header;
- the slots of the plurality of slots of the tube extend up to the upper end of the tube, at which end they emerge, and the cap has a domed top, an inner surface of which includes a cavity for receiving the upper end of the tube to which the cap is fixed;
- for each of the feedwater distribution means, the cap is fixed to the tube by means of fixing fingers of substantially radial direction that are distributed around the periphery of the cap and of the tube, each finger being welded onto an outer surface of the tube and to the side wall of the cap;
- the slots passing through the wall of an upper part of the tube of each of the feedwater distribution means extend along the axial longitudinal direction up to a certain distance from the upper end of the tube that includes a solid part at its upper end in which a plug for closing off the upper end of the tube is engaged, which plug-has an upper end part engaged in an opening passing through a closure top of the cap in its central part, the plug being welded onto the end of the tube and, via its end part, onto the top of the cap;
- passing axially through the plug is at least one slot placed at its periphery and opening onto the lateral surface of the plug, in a part of the plug with a larger diameter engaged inside the tube for closing off its upper end;
- the header of the feedwater distribution device includes at least one inspection opening passing through the wall of the toroidal header in an upper end part of the toroidal header having removable closure means;
- the removable closure means of the inspection opening in the toroidal header are formed by a support ring, that is fixed by welding at the opening passing through the wall of the toroidal header in its upper part, and by a cover that may be engaged in the fixing ring and fixed by bolts to the fixing ring;
- the header comprises a shell in the form of a portion of a torus extending along only part of parallel circular lines of the torus and bounded, at its ends, by meridional sections of the torus along which the toroidal shell of the header has inspection openings that can be closed by removable closure means.

In order to understand the invention clearly, there now follows a description, by way of example, and with reference to the appended figures, of a steam generator according to the invention and in particular of its feedwater delivery device.

DETAILED DESCRIPTION OF THE INVENTION

Figure 1:
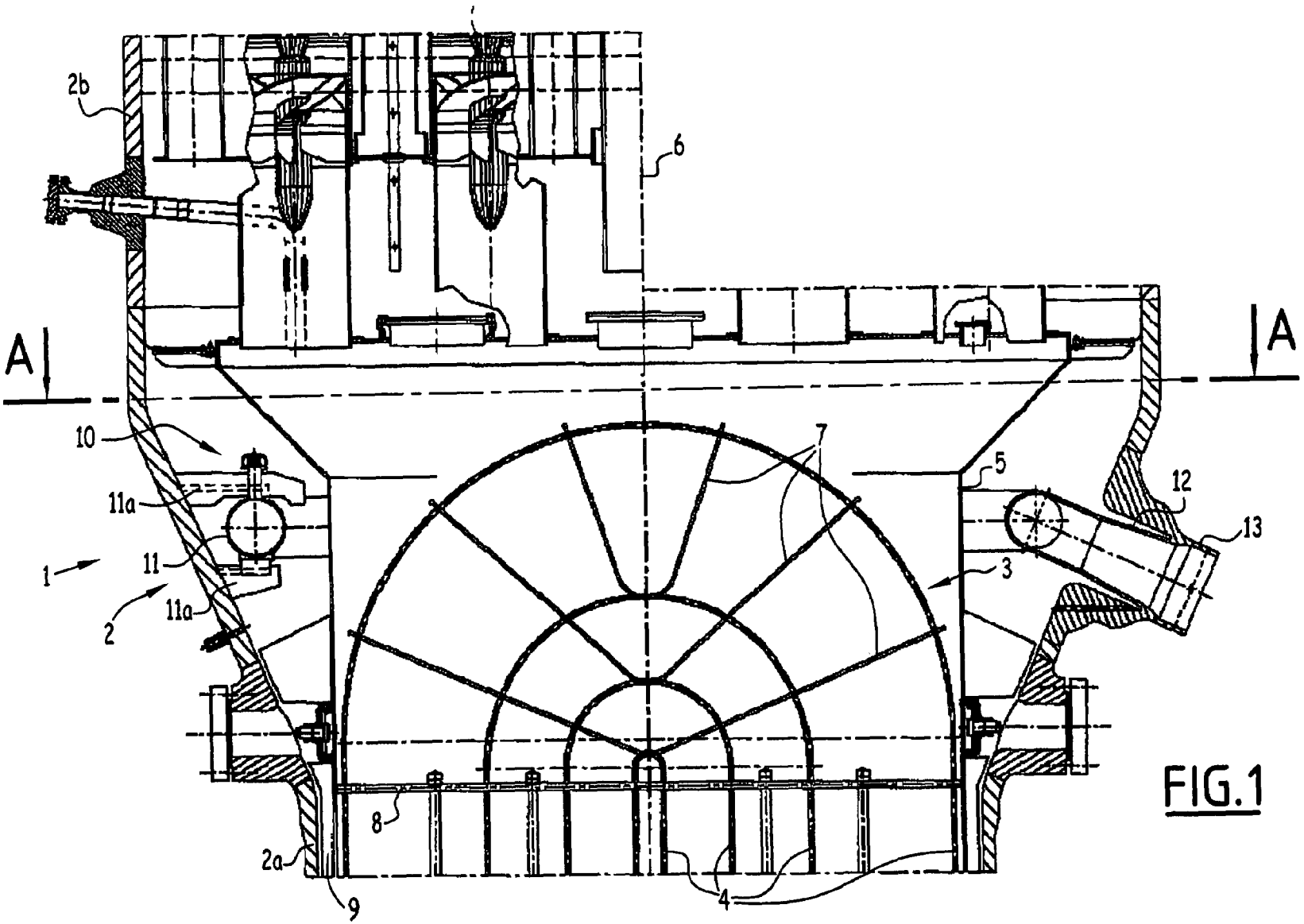
FIG. 1 is a partial sectional view of the upper part of a steam generator according to the invention.

FIG. 1 is a partial axial section through an upper part of the steam generator denoted in general by reference 1, which comprises an outer shell 2 of cylindrical overall shape, comprising a lower part 2*a* having a first diameter, an upper part 2*b* having a second diameter, greater than the first diameter, and a junction part of frustoconical general shape between the smaller-diameter lower part 2*a* and the larger-diameter upper part 2*b*.

The steam generator bundle 3 formed by tubes 4 bent into the form of a U is contained in a bundle wrapper 5 of cylindrical overall shape placed in a coaxial arrangement inside the outer shell 2, the outer shell 2 and the bundle wrapper 5 having the same axis of symmetry 6 lying vertically.

FIG. 1 shows, for greater clarity, only four tubes 4 of the steam generator bundle 3, each of the tubes having two straight branches and a bent part in the form of a semicircle, the bending radius of the tubes 4 decreasing from the outside of the bundle inwards. The tubes 4 of the bundle are also placed in juxtaposed plane rows, anti-vibration bars 7 being inserted between these rows in the upper part of the bundle 3 so as to limit the vibration of the tubes in the generator when operating. The straight legs of the tubes are held in place by spacer plates such as 8.

The lower parts of the straight legs of the tubes 4 of the steam generator bundle 3 are fixed in a tube plate; these parts of the tubes and the tube plate have not been shown in FIG. 1.

The lower part 2*a* of the outer shell of the steam generator and the bundle wrapper 5 between them define an annular space 9 that communicates, in its lower part (not shown), with a lower end of the bundle and, in its upper part, with an annular feedwater distribution space bounded between the upper part of the bundle wrapper 5 and the frustoconical part of the outer shell 2, in which space the toroidal header of the steam generator feedwater distribution device is placed, this device being denoted in general by the reference 10.

The bundle wrapper 5 is closed in its upper part by a horizontal wall to which cyclone-type separators are fixed, these separators being used to separate, from the steam formed on contact with the tubes 4 of the bundle 3, the water droplets entrained by the steam.

During operation of the steam generator, primary water heated on contact with the nuclear reactor core flows inside each of the tubes 4 of the bundle 3 and feedwater injected into the annular space 9 by the feedwater distribution device 10 and reaching the lower part of the bundle flows upwards in contact with the tubes of the bundle so as to be heated then vaporized, before being discharged, at the upper part of the steam generator, into steam separator-dryers.

The feedwater distribution device 10 must ensure uniform distribution of the feedwater in the upper part of the annular space 9 communicating with the distribution space, that is to say a desired distribution of the water around the circumference of the distribution space.

The feedwater distribution device 10 comprises a toroidal header 11 placed so as to be coaxial with the outer shell 2 and with the bundle wrapper 5 in the distribution space, the toroidal shell of the distribution header 11 having, as meridional axis, the axis 6 of the steam generator. The toroidal shell of the header 11 is fixed to the outer shell by means of support devices 11*a*, 11*b*, 11*c* (FIGS. 1 and 3A) and is connected to a feed pipe 12 fastened to a nozzle 13 that penetrates the outer shell 2 of the steam generator, in its frustoconical part defining the distribution space.

Figure 2:
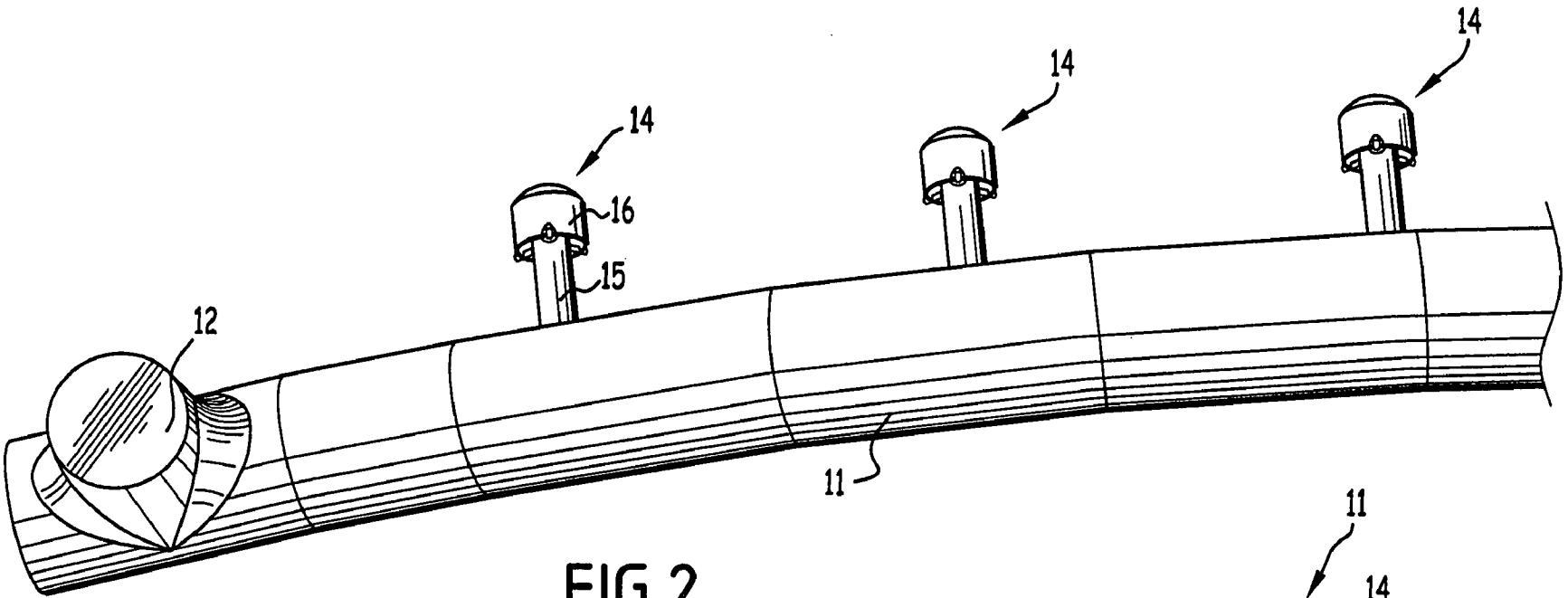
FIG. 2 is a perspective view of a part of the toroidal header of the feedwater delivery device of the steam generator shown in FIG. 1.
Figure 3B:
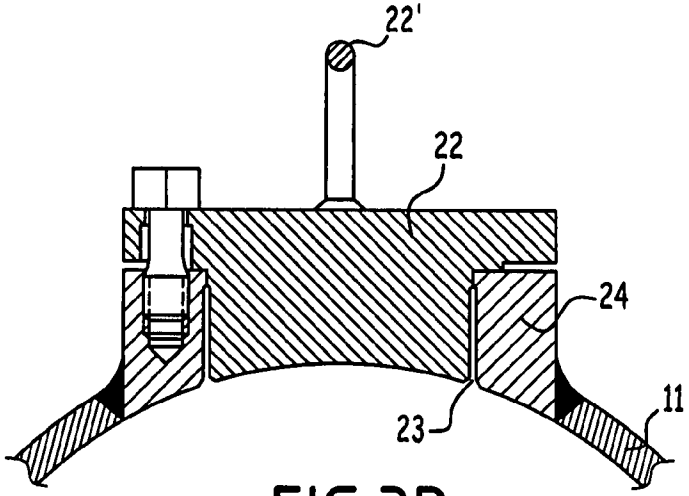
FIG. 3B is a sectional view on B—B of FIG. 3A.
Figure 3C:
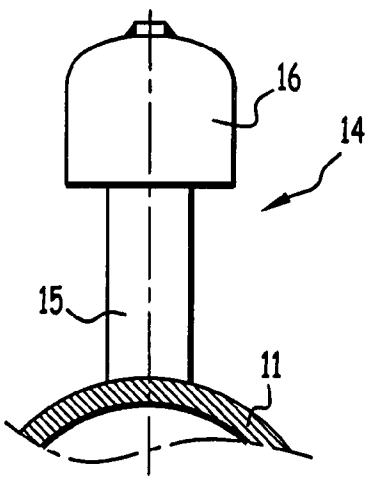
FIG. 3C is a sectional view on C—C of FIG. 3A.
Figure 3A:
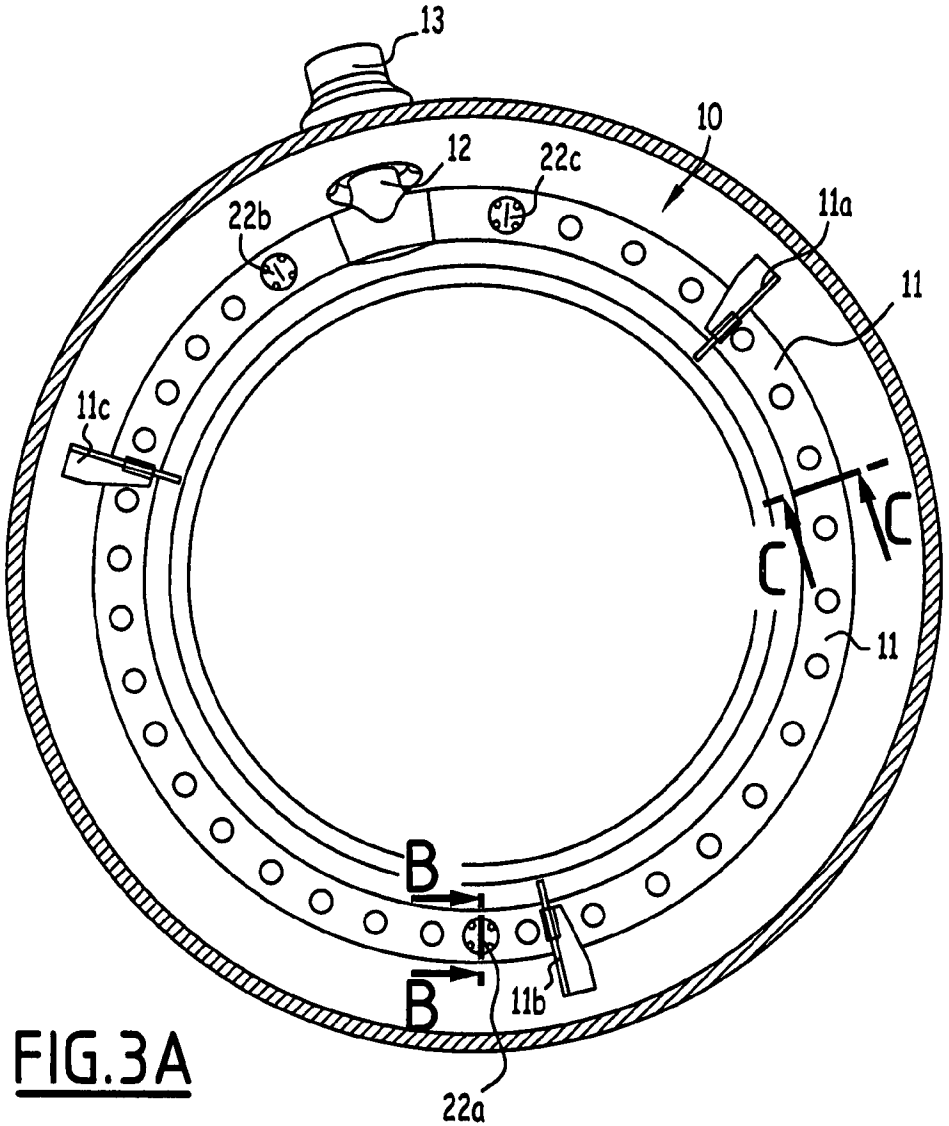
FIG. 3A is a cross-sectional view on A—A of FIG. 1 showing in particular the toroidal header of the feedwater distribution device of the steam generator.

As is visible in particular in FIGS. 2 and 3A, feedwater distribution means 14 are fixed to the upper part of the toroidal shell of the header 11 and are distributed around to circumference of the toroidal wall of the header 11 at predefined intervals.

Each of the feed means 14 comprises a tube 15 placed approximately vertically, that is to say with an axis parallel to the axis 6 of the steam generator, and a cap 16 covering the upper part of the tube 15.

Figure 4B:
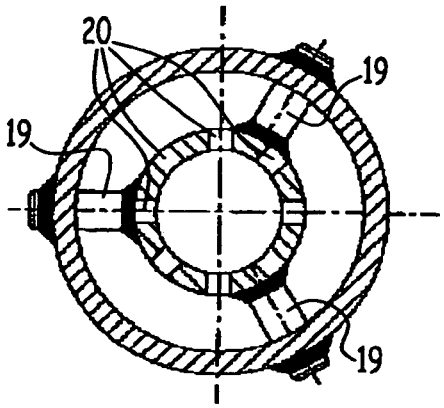
FIG. 4B is a sectional view on B—B of FIG. 4A.
Figure 4A:
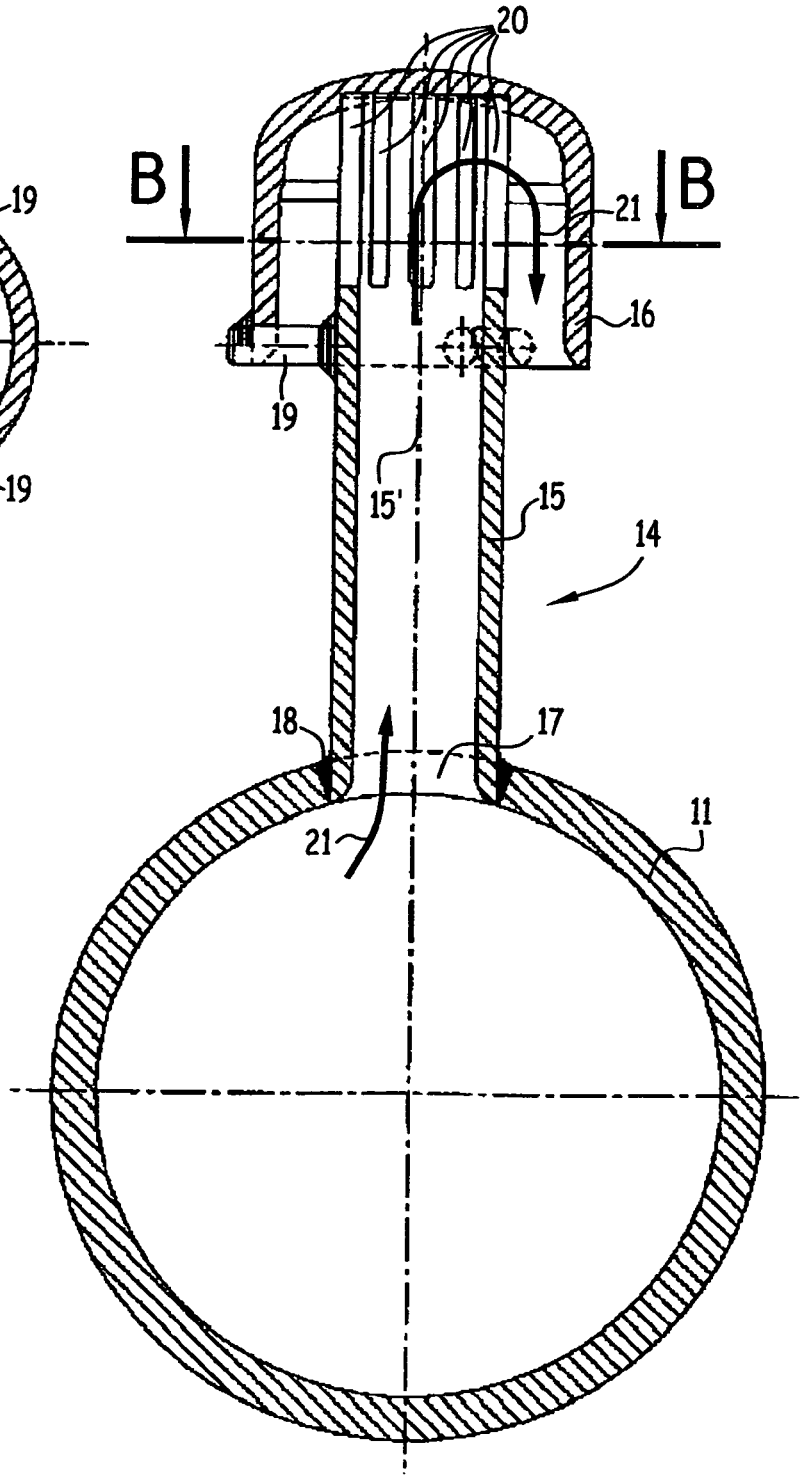
FIG. 4A is a sectional view in a meridional plane of the toroidal header, at a feedwater distribution tube.

As may be seen in particular in FIG. 4A, each of the tubes 15 of an individual feedwater distribution means 14 is fixed at an opening 17 in the upper part of the wall of the toroidal header 11 by means of a fixing and sealing weld 18.

In the embodiment shown in FIGS. 4A and 4B in particular, the cap 16 of the distribution means 14, which has an approximately cylindrical side wall and a slightly domed top, is fixed to the upper end part of the tube 15, the lower end of which is fixed to the toroidal shell of the header 11 by means of at least two radially directed pins, for example three radially directed pins 19, that are welded to the outer surface of the tube 15 and to the outer surface of the side wall of the cap 16. The fixing pins 19 placed at 120° to one another are engaged in recesses made in the lower part of the cap 16.

The upper end of the tube 15 is engaged in a circular opening machined in the internal part of the domed top of the cap 16, so as to centre the cap 16 with respect to the tube 15. The side wall of the cap 16 surrounds the upper part of the tube 15 with a certain radial clearance, the said upper part being penetrated by longitudinal slots 20 along the direction of the axis 15' of the tube 15; each of the slots 20 has a width, in the circumferential direction of the tube 15, that is less than the characteristic dimension of foreign bodies that it is desired to trap within the water distribution means 14.

It is possible to provide, for example as shown in FIG. 4B, eight water distribution slots 20 placed at 45° to one another around the axis 15' common to the tube 15 and to the cap 16, but other arrangements are possible.

As shown by the arrows 21, the feedwater, introduced into the toroidal shell of the header 11 by the feed pipe 12 connected on the outside of the steam generator to a pipe of the secondary system of the nuclear reactor, is distributed in each of the tubes 15 of the distribution means 14, through the openings 17 in the toroidal header, then flows axially inside the tube 15 in order to reach the upper part of the tube 15 closed off by the cap 16. The feedwater passes through the wall of the tube 15 at the slots 20 and then the flow of water is directed in the opposite direction, that is to say vertically downwards by the cap 16. In this way, the desired feed of the annular space of the steam generator by the distribution means 14 distributed around the circumference of the toroidal shell is ensured. At each of the distribution means 14, the feedwater is distributed in a pre-established manner around the periphery of the tube 15, inside the cylindrical side wall of the cap 16. The feedwater distributed in the form of jets formed by the slots 20 produces no swirling or disturbance in the upper part of the annular feed space of the steam generator.

Furthermore, if foreign bodies are transported by the feedwater, these foreign bodies are stopped by the slots 20 and can drop down into the toroidal shell of the header 11, so that they are not entrained into the annular space and the bundle of the steam generator.

After the steam generator has operated for a certain time, the foreign bodies present in the toroidal header 11 must be recovered and removed, in order to avoid fouling the header 11.

To do this, inspection hatches, such as 22*a*, 22*b* and 22*c*, may be provided close to and on either side of the feed pipe 12 and in an approximately diametrically opposed position, as may be seen in FIG. 3A.

Shown in FIG. 3B is an inspection cover 22 that is fixed, for example by bolts, to a cover support ring 24 fixed by welding to the shell of the header 11 at an opening 23 penetrating the upper part of the toroidal shell of the header. The cover 22 may include a lifting ring 22*a* in order to make it easier to handle.

During a shutdown and maintenance phase of the nuclear reactor, access may be gained to the inside of the toroidal shell 11 of the feedwater distribution device 10 after the covers, such as 22*a*, 22*b* and 22*c*, have been opened. The foreign bodies present inside the shell of the header 11 may be recovered, for example by suction.

Figure 5B:
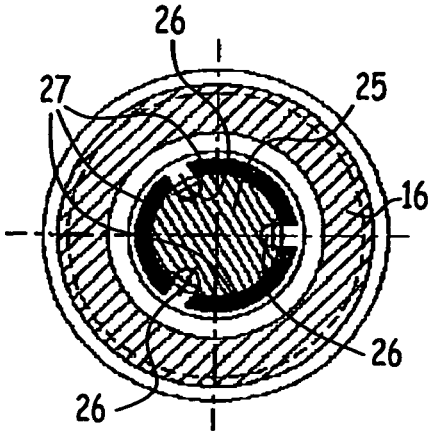
FIG. 5B is a cross-sectional view on B—B of FIG. 5A.
Figure 5A:
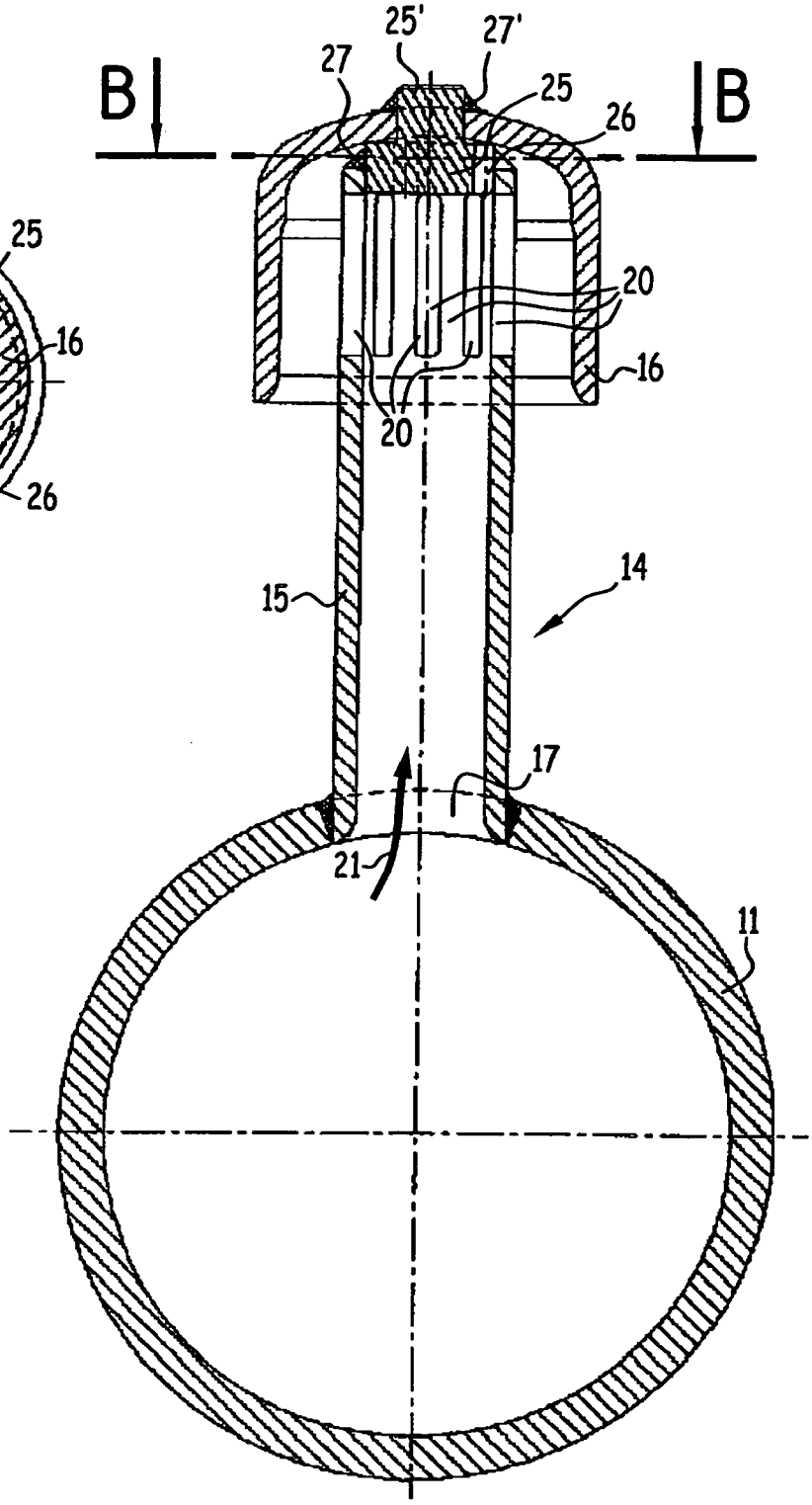
FIG. 5A is a sectional view similar to the view of FIG. 4A of an alternative embodiment of the toroidal header and of its distribution devices.

FIGS. 5A and 5B show an alternative embodiment of a feedwater distribution means 14.

The corresponding elements of the distribution means according to the embodiment shown in FIGS. 5A and 5B and of the distribution means shown in FIGS. 4A and 4B described above are denoted by the same reference numbers.

In the case of the embodiment described with regard to FIGS. 4A and 4B, the feedwater passage slots 20 extend as far as the upper end of the tube 15, at which end the slots emerge.

In the case of the embodiment according to the variant shown in FIGS. 5A and 5B, the slots 20 passing through the wall of the tube 15 do not emerge into the upper end of the tube, which has a solid part over an axial length allowing a closure plug 25 to be engaged on the end of the tube 15, the plug 25 having a larger-diameter part for engagement on and fixing to the tube 15 and a smaller-diameter part 25' that is intended to be engaged in an opening passing through the domed top of the cap 16 in its central part, in order to mount and assemble the distribution means 14.

The plug 25 also includes, in its larger-diameter part for plugging the tube 15, three slots 26, of axial direction, emerging on its periphery and placed at 120° to one another. The slots 20 of the tube 15 and the slots 26 of the plug 25 have approximately the same width, this width ensuring that foreign bodies of characteristic size entrained by the feedwater are trapped.

The plug 25 engaged in the solid end part of the tube 15, via its larger-diameter part, is fixed in a sealed manner to the end of the tube by a weld 27 and the smaller-diameter part 25' of the plug 25 passing through the cap 16 is fixed at its end to the outer surface of the domed top of the cap 16 by a weld 27'.

The operation and advantages of the feedwater distribution means shown in FIGS. 5A and 5B are the same as those of the device shown in FIGS. 4A and 4B.

Figure 6:
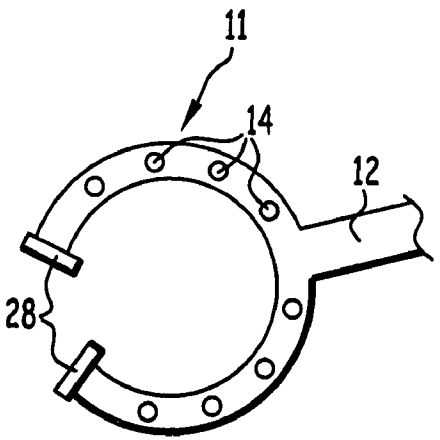
FIG. 6 is a schematic top view of a toroidal steam generator header according to an alternative embodiment.

As may be seen in FIG. 6, according to an alternative embodiment, the feedwater distribution header 11 of the steam generator may have a shell of toroidal general shape extending only over part of the circumference of the parallel circles of the torus.

In this case, the feedwater distribution means 14 may again be produced in the same manner as described previously. The foreign bodies trapped inside the toroidal shell 11 may be recovered via the two free ends of the toroidal shell, after the sealed closure covers 28 fixed to the ends of the toroidal shell 11, in meridional sections of the toroidal shell 11, have been removed.

The device according to the invention therefore makes it possible to provide, in all cases, both a desired distribution of feedwater in the upper part of the annular distribution space, without creating any disturbance by the flows coming from the feed means, and very effective stopping of foreign bodies entrained by the feedwater.

The invention is not strictly limited to the embodiments that have been described.

Thus, the tubes of the feedwater distribution means may have different openings of slots in their upper part. The cap for closing off the ends of the tube may also have a shape other than that described.

The invention applies to any steam generator having a feedwater distribution header above an annular space of the steam generator.

The invention claimed is:

1. Steam generator comprising:

an outer shell of cylindrical general shape placed with its axis vertical;

a bundle of exchange tubes that are fastened inside a bundle wrapper of cylindrical general shape placed coaxially inside the outer shell so as to define, with one of the outer shell and of a skirt coaxial with the outer shell, an annular space for water from the steam generator to flow axially;

a feedwater delivery device, at an upper axial end of the annular space, having a header of toroidal general shape approximately coaxial with the outer shell and with the annular space;

at least one feed pipe for the header passing through the outer shell;

means for distributing the feedwater in the upper part of the annular space, these distributing means being formed by a plurality of openings that pass through an upper wall of the toroidal header and are distributed circumferentially on the wall of the header;

the distributing means further including a plurality of substantially vertical distribution tubes that are fixed at a respective lower end thereof to a corresponding opening in the wall of the toroidal header;

wherein the tubes of the feedwater distribution means are straight and placed vertically and wherein each of the tubes of the feedwater distribution means has, in an upper ends section:

(a) at least one water passage opening passing through the wall of the tube; and (b) a cap that is fastened to the tube and has a lateral surface of substantially cylindrical shape and a top sealing the open upper end of the tube, in an approximately coaxial arrangement, surrounding with a radial clearance, the upper end part of the tube through which the water passage opening passes, one dimension of the opening being less than a characteristic dimension of foreign bodies contained in the feedwater of the steam generator.

2. Steam generator according to claim 1, wherein the water passage opening includes a plurality of slots of axial longitudinal direction that are distributed around the circumference of the tube and having, in the circumferential direction, a width that is less than a characteristic dimension of foreign bodies to be trapped in the feedwater header.

3. Steam generator according to claim 2, wherein the slots extend up to the upper end of the tube, at which end they emerge; and wherein the cap has a domed top, an inner surface of which includes a cavity for receiving the upper end of the tube to which the cap is fixed.

4. Steam generator according to claim 3, wherein each cap is fixed to a respective tube by means of fixing fingers of substantially radial direction that are distributed around the periphery of the cap and of the tube, each finger being welded onto an outer surface of the tube and to the side wall of the cap.

5. Steam generator according to claim 2, wherein the slots extend along the axial longitudinal direction up to a certain distance from the upper end of the tube that includes a solid part at its upper end in which a plug is inserted for closing off the upper end of the tube the plug having an upper end part inserted into an opening passing through the closure top of the cap in its central part, the plug being welded onto the end of the tube and, via its end part, onto the top of the cap.

6. Steam generator according to claim 5, wherein, passing axially through the plug is at least one slot placed at its periphery and opening onto the lateral surface of the plug, in a part of the plug with a larger diameter received inside the tube for sealing its upper end.

7. Steam generator according to any one of claims 1 to 6, wherein the header of the feedwater distribution device includes at least one inspection opening passing through the wall of the toroidal header in an upper end part of the toroidal header and having removable closure means.

8. Steam generator according to claim 7, wherein the removable closure means of the inspection openings in the toroidal header are formed by a support ring, that is fixed by welding at the opening passing through the wall of the toroidal header in its upper part, and by a covers that may be received in the fixing ring and fixed by bolts to the fixing ring.

9. Steam generator according to any one of claims 1 to 6, wherein the header comprises a shell in the form of a portion of a torus extending along only part of parallel circular lines of the torus and bounded, at its ends, by meridional sections of the torus, the meridional sections having inspection openings that can be closed by removable closure means.

* * * * *